US006439559B1

(12) United States Patent
Kinnard et al.

(10) Patent No.: US 6,439,559 B1
(45) Date of Patent: Aug. 27, 2002

(54) VACUUM CONTROL DEVICE FOR HOLDING A WORKPIECE

(75) Inventors: Steve Patrick Kinnard, Milwaukee; Eugene T. Plitt, Muskego; Eugene W. Plitt, Waukesha, all of WI (US)

(73) Assignee: Bay View Industries, Inc., Oak Creek, WI (US)

( * ) Notice: Subject to any disclaimer, the term of this patent is extended or adjusted under 35 U.S.C. 154(b) by 0 days.

(21) Appl. No.: 09/731,439

(22) Filed: Dec. 5, 2000

(51) Int. Cl.[7] ..... B25B 11/00
(52) U.S. Cl. ..... 269/21; 269/286
(58) Field of Search ..... 269/21, 286, 20; 279/3; 294/64.1; 451/388

(56) References Cited

U.S. PATENT DOCUMENTS 3,593,983 A * 7/1971 Csenyi ..... 269/21
4,184,292 A * 1/1980 DeFazio et al. ..... 269/21
5,222,719 A 6/1993 Effner
5,899,445 A * 5/1999 Kimble ..... 269/21
6,196,532 B1 * 3/2001 Otwell ..... 269/21

* cited by examiner

*Primary Examiner*—Joseph J. Hail, III
*Assistant Examiner*—Lee Wilson
(74) *Attorney, Agent, or Firm*—Reinhart Boerner Van Deuren, s.c.

(57) ABSTRACT

The present invention relates to a vacuum control device used for holding a workpiece during the machining process. The vacuum control device may be activated by placing the workpiece onto the vacuum control device. Once the workpiece is removed, the vacuum control device is deactivated, no longer drawing a vacuum.

8 Claims, 5 Drawing Sheets

VACUUM CONTROL DEVICE FOR HOLDING A WORKPIECE

BACKGROUND OF THE INVENTION

Field of the Invention

The present invention relates generally to a vacuum control device used for holding a workpiece, and more particularly, to a vacuum control device which may be activated by placing the workpiece on the vacuum control device without having to first manually invert the vacuum control device.

Vacuum worktables have been designed and used to hold a variety of workpieces for different machining operations including cutting, routing, sawing, and grinding. To prevent the workpiece from moving during the machining process, worktables have been constructed with vacuum pumps that pull air through the worktable to hold the workpiece in place. An example of such a worktable is disclosed in U.S. Pat. No. 5,222,719, to Effener, et al. The worktable disclosed in the Effener patent includes a plurality of recessed openings distributed over the worktable surface. A pod may be placed within each of these recessed openings.

The pod disclosed in the Effener patent is circular with a central boss that extends from a base in an offset manner. The base has a central opening to allow air to pass therethrough. The pod may be placed within the recessed opening in either an activated or deactivated position.

In the activated position, the base sets over the recessed opening with the central boss extending away from the worktable. The air can then pass through the central opening and into the worktable through vent openings positioned adjacent to the walls of the recessed opening when the vacuum pump is started. With air flow, a worker can set a workpiece atop of the central boss to form vacuum between the workpiece and the pod.

A worker must manually invert the pod in the deactivated position to prevent air from passing through the pod to create the vacuum. In the deactivated position, the base sets over the recessed opening with the offset central boss extending to the floor of the recessed opening. This forms an annular chamber between the offset central boss and the wall of the recessed opening. The annular chamber is the only space that communicates with the vented opening and contains the only air that will be evacuated when the vacuum pump is started.

Other manufacturers have developed similar pods to regulate vacuum pressure. Carter Products Company, Inc. of Grand Rapids, Mich. developed a pod that utilizes a ball as a valve to regulate air flow. The ball sets inside a central chamber open to and surrounded by an annular outer chamber. Air may pass through openings at each end of the central chamber. However, a ball check is placed over an opening at one end of the central chamber and guides the ball over the opening when the pod is placed in the deactivated position. The ball closes this opening to prevent air from passing through the pod to the worktable, thus preventing a vacuum to form between a workpiece and the pod.

The Carter pod is placed in the activated position when a worker manually inverts the pod in one of the recessed openings of the worktable. In the activated position, the ball falls to the side of the airflow opening, allowing air to pass through the pod. A worker may then place a workpiece atop of the pod to form a vacuum between the workpiece and worktable. Although a vacuum is eventually formed, the vacuum pump must first evacuate the air from both the central chamber and the surrounding annular chamber to reduce the internal pressure of the pod enough to create the vacuum.

One of the disadvantages and limitations of the pre-existing pods disclosed above is that manual labor is required to activate or deactivate the pods. All pods of the prior art require a worker determine where the workpiece will fit over the worktable and what pods must be activated to safely and securely hold the workpiece in place. In those areas of the worktable where the worker determines no vacuum is required, the worker must manually invert the pods from the activated to deactivated position. The worker is then required to position the workpiece over the activated pods and if any changes are necessary, the worker must repeat this process. This is a time consuming and tedious matter that results in lost time and money.

Further, the pods of the prior art include multiple chambers which must be evacuated before a sufficient negative pressure is created to draw a vacuum between the pods and a workpiece. Multiple chambers create a larger total internal volume. The greater the volume, the longer it takes to remove the gases from those spaces to create the negative atmospheric pressure. Again, this increased waiting time translates to lost time and money.

Lastly, the pods of the prior art do not have a mechanism that adequately prevents the pods from scratching or denting the workpiece. Many workpieces are made from expensive and fragile materials susceptible to scratching, denting or breaking. These workpieces are often damaged during the machining process from the pods which are made of rigid materials.

To overcome the disadvantages and limitations associated with the prior art, an objective of the vacuum control device of the present invention is that it be able to regulate the vacuum pressure without requiring a worker to manually invert or flip the vacuum control device. The vacuum control device should be activated when a workpiece is placed atop of the vacuum control device and deactivated when the workpiece is removed. Further, the vacuum control device should also be able to filter out dust, dirt and other debris from the work environment so that the longevity of the products can be sustained.

Another objective of the vacuum control device is that it be capable of setting in a recessed opening of a worktable removed from a cutting device. This would create a clear machining path and prevent damage to the vacuum control device. In the cutting position, the vacuum control device should be deactivated to prevent air from passing through the vacuum control device. The vacuum control device should also be made from a material that will not damage the cutting device if the cutting device accidentally strikes the vacuum control device when the vacuum control device is not placed in the cutting position.

As a further objective, the vacuum control device should securely set within the recessed opening in either the operating or cutting position so that the workpiece may not slide or move while being machined.

Yet another objective of the vacuum control device is that it should have a single chamber to restrict the internal volume of the vacuum control device. This should allow a rapid evacuation of air from the vacuum control device to efficiently provide sufficient vacuum to hold the workpiece securely and firmly in place so that the workpiece may be worked upon without dangerous and inefficient slipping or sliding. Further, the vacuum control device should be fitted with a mechanism to prevent air from escaping between the vacuum control device and the workpiece while providing scuff or dent resistance.

Finally, it is also an objective of the vacuum control device that all the aforesaid advantages and objectives be achieved without incurring any substantial relative disadvantage.

SUMMARY OF THE INVENTION

The disadvantages and limitations of the background art discussed above are overcome by a vacuum control device for holding a workpiece that is taught by the present invention.

The vacuum control device of the present invention includes a body that may be securely placed within a recessed opening of a worktable. The body has two sides a support side and a seating side, both separated by a flange. The flange extends outwardly from the body and is constructed to rest within a mating ledge surrounding each recessed opening. Either the support side or the seating side can fit within the recessed opening.

The body surrounds an interior chamber that is open on the seating side and is partially closed by a top wall on the support side. The top wall includes a stem aperture flanked by at least one vacuum hole, both providing an opening to the interior chamber. The top wall may be either contiguous with the body or a separate piece attached to the body.

The interior chamber houses a valve that controls vacuum pressure by regulating the passage of air through the interior chamber. The valve includes a plunger and a spring. The plunger has a stem and a vacuum stop. The stem protrudes through the stem aperture of the top wall and extends beyond the outmost plane of the vacuum control device. The vacuum stop is either connected to the stem by a fastener or is contiguous with the stem. The vacuum stop is constructed to prevent the plunger from completely passing through the stem aperture, and to cover each vacuum hole when pressed against the top wall.

The spring is partially compressed and situated behind the plunger in the interior chamber to force the plunger firmly against the top wall and obstruct each vacuum hole. The spring maintains its partially compressed state within the passage by resting between the plunger and a base. The base covers the opening to the interior chamber at the seating side and is removably connected to the body by one or more removable fasteners. The base should be rigid enough to withstand the force exerted on the base from the spring and allow air to pass through the base, while preventing the passage of dirt, dust and other debris. This may be accomplished by a porous base or filter.

The vacuum control device regulates the flow of air when used in combination with a workpiece and a worktable. The vacuum control device is placed in a position to allow air to pass through the interior chamber and into the worktable when the seating side is placed into the recessed opening with the support side rising above the worktable. A worker may then start a vacuum pump connected to the worktable which pulls air through the recessed opening and the base to evacuate air from the interior chamber. However, the vacuum control device prevents air flow from outside the vacuum control device in this position because the spring forces the vacuum stop against the top wall to obstruct each vacuum hole.

A worker may then activate the vacuum control device by placing a workpiece upon the vacuum control device. The weight of the workpiece depresses the stem and separates the vacuum stop from the top wall to clear each vacuum hole. Air can then pass through each vacuum hole from the space between the workpiece and the vacuum control device through the interior chamber. As air evacuates from between the workpiece and the worktable, a negative atmospheric pressure is created which causes a vacuum to form between the workpiece and the support side. The vacuum firmly holds the workpiece to the vacuum control device so that the workpiece may be machined cleanly, safely and efficiently.

When a worker lifts the workpiece from the vacuum control device, the spring again forces the vacuum stop against the top wall to obstruct each vacuum hole and deactivate the vacuum control device. The spring is allowed to force the plunger against the top wall without the weight of the workpiece because the spring is in a partially compressed state.

A vacuum seal between the workpiece and the body may be strengthened by a seal ring. The seal ring may be in the form of an o-ring that sets atop of the support side or a cover that fits over the support side. The seal ring eliminates any gaps between the workpiece and the vacuum control device caused by surface irregularities on the workpiece. The seal ring may be made from pliable plastic, rubber or other similar material that is impervious to air and will help prevent scratching, scuffing and denting the workpiece.

To maintain a clean interior chamber and valve mechanism, a filter may be used to prevent dirt, dust and other debris from passing through each vacuum hole. The filter may be placed over the surface of the top wall opposite the interior chamber so that it covers each vacuum hole. The filter should also include a matching stem aperture so that the stem may protrude from the interior chamber. The filter may be secured to the vacuum control device by being placed between the top wall and the seal ring. The filter may be of the same porous material as the base with pores large enough to allow air to pass through the filter but prevent dirt, dust and other debris from fouling the interior chamber and valve mechanism.

The vacuum control device may also be positioned in a cutting position to prevent the vacuum control device from being damaged by the machining tool and to prevent damage to the machining tool. In the cutting position, the support side is placed within the recessed opening with the seating side rising above the surface of the worktable. The seating side should have a height less than the support side as measured from the flange if the vacuum control device is to be used in the cutting position. The height difference will allow a space to form between the seating side and a workpiece resting on the support side of an adjacent vacuum control device. This space provides a path for the machining tool as it cuts through the workpiece.

Thus, it may be seen that the vacuum control device of the present invention overcomes the disadvantages and limitations associated with the prior art by providing the aforesaid characteristics. The vacuum control device is able to regulate the vacuum pressure without a worker having to manually invert or flip the vacuum control device. Further, the vacuum control device is able to filter out dust, dirt and other debris from the work environment to sustain the longevity of the vacuum control device and the worktable.

In addition, the vacuum control device is capable of being set in a recessed opening of a worktable in a cutting position, removed from the cutting path. When the vacuum control device is in the cutting position, a machining path is then created. This prevents damage to the vacuum control device and the machining tool. The vacuum control device is also made from material that will not damage the cutting device should cutting device accidentally hit the vacuum control device.

Furthermore, the vacuum control device rests securely within the recessed opening in both the operating position and the cutting position. This prevents the workpiece from sliding or moving while being machined and eliminates any safety or inefficiency problems associated with other vacuum control devices that slip and slide.

Also, the vacuum control device has only the interior chamber between the worktable and the workpiece. The air from the interior chamber can be evacuated rapidly to create a sufficient vacuum to hold a workpiece securely and firmly in place so that the workpiece may be worked upon without dangerous and inefficient slipping or sliding. Further, the vacuum control device can be fitted with a seal ring to prevent air from escaping between the vacuum control device and the workpiece. The seal ring also provides scuff and dent resistance. Finally, all of the aforesaid advantages and objectives are achieved without incurring any substantial relative disadvantage.

The above brief description sets forth rather broadly the more important features of the present invention so that the detailed description that follows may be better understood, and so that the present contributions to the art may be better appreciated. There are, of course, additional features of the invention that will be described hereinafter, which will form the subject matter of the invention. In this respect, before explaining an embodiment of the invention in detail, it is to be understood that the invention is not limited in its application. The details of the construction and the arrangements set forth in the following description are illustrated in the drawings. But, the present invention is capable of other embodiments and of being practiced and carried out in various ways, as will be appreciated by those skilled in the art. Also, it is to be understood that the phraseology and terminology employed herein are for description and not limitation.

DESCRIPTION OF THE DRAWINGS

These and other advantages of the present invention are best understood with reference to the drawings, in which.

DETAILED DESCRIPTION OF THE PREFERRED EMBODIMENTS

Figure 1:
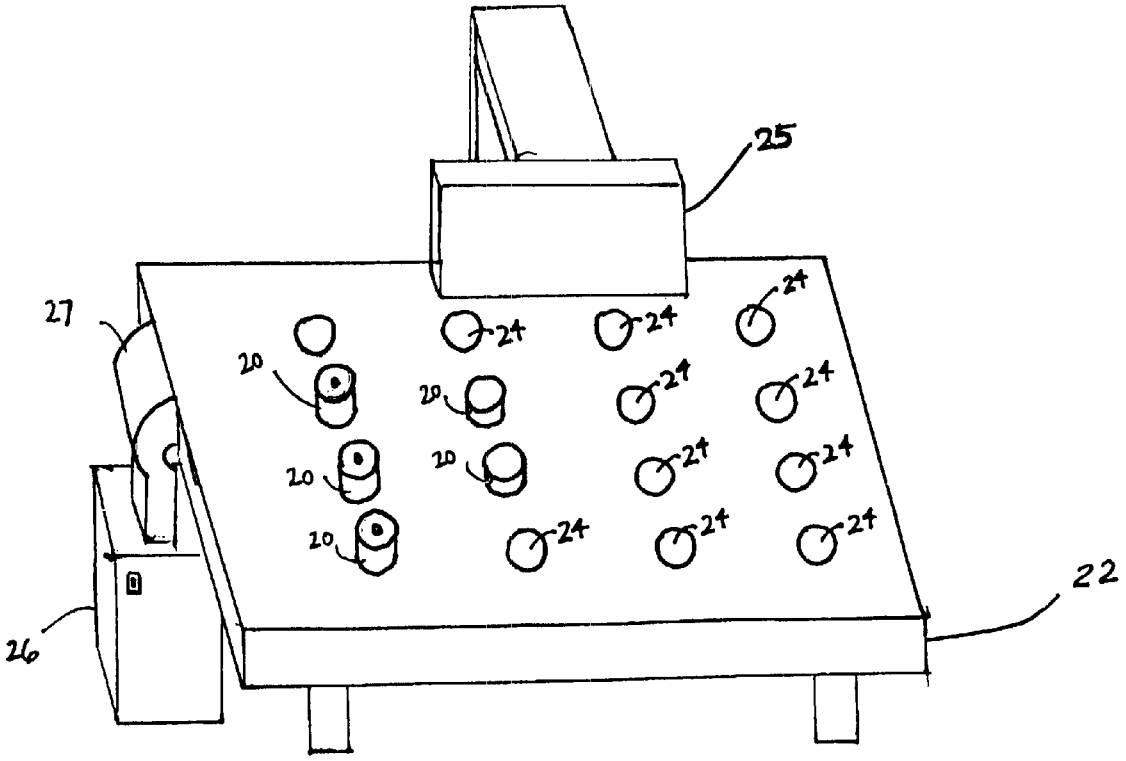
FIG. 1 is an oblique view of a machine tool having a worktable equipped for use in combination with the teachings of the present invention.

FIG. 1 illustrates the vacuum control device 20 taught in accordance with the teachings of the present invention. The vacuum control device 20 is used in combination with a worktable 22 having a plurality of recessed openings 24, each of which being connected to a vacuum pump 26 by a hose 27 or other method known by those skilled in the art. The worktable 22 may be for any machine tool 25, including both commonly and numerically controlled machines to cut, router, drill, or grind a variety of workpieces made from a variety of materials.

Figure 2:
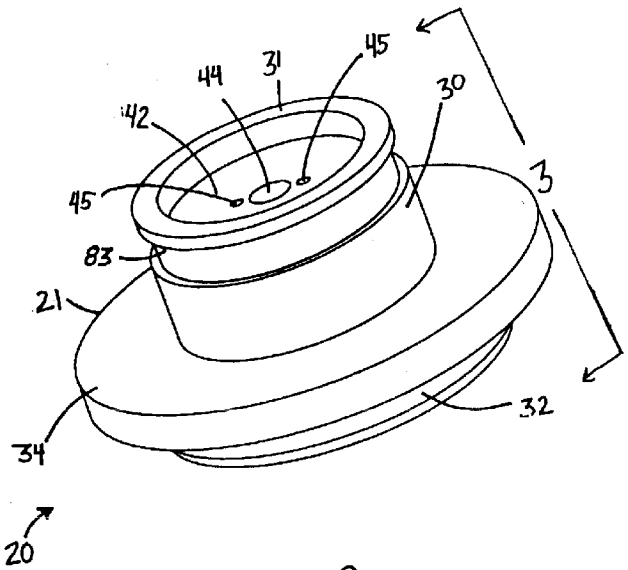
FIG. 2 is an elevational view of a vacuum control device in accordance with the teachings of the present invention.

FIG. 2 more clearly shows the vacuum control device 20 of the present invention. In the preferred embodiment, the vacuum control device 20 has a body 21 that is generally cylindrical and is divided into two sides, a support side 30 and a seating side 32. Both sides 30, 32 are separated by a circumferential flange 34 that is coaxial with and extending outwardly from the body 21. The seating side 32 may have a height less than that of the support side 30 as measured from the flange 34 to provide a height adjustment mechanism determined by how the vacuum control device 20 is placed within the recessed opening 24.

As is readily apparent to one skilled in the art, the body 21 and the flange 34 may be configured in a variety of shapes and sizes to fit the particular worktable 22 and recessed opening 24 that the vacuum control device 20 is used in combination with during the machining process. For example, instead of an abruptly outward extending flange, the body may be angled at both sides towards center to form the flange that will prevent the vacuum control device from falling into the recessed opening while securely positioning the vacuum control device. In addition, circular recessed openings are presently the most common design and the embodiments and features of the present invention described herein reflect that design and are not meant to be a limiting feature.

Figure 3:
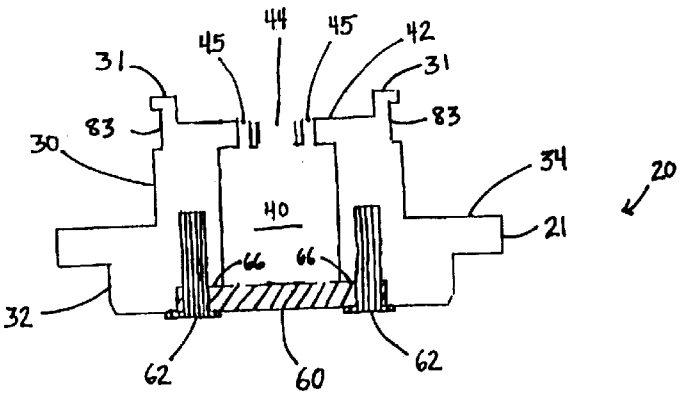
FIG. 3 is a cross-sectional side view of the vacuum control device as shown in FIG. 2 without a valve.

The body 21 surrounds an interior chamber 40 as more clearly shown in FIG. 3. The interior chamber 40 opens to the seating side 32, but is partially closed by a top wall 42 at the support side. The top wall 42 has a stem aperture 44 which opens to the interior chamber 40 and may be flanked by at least one vacuum hole 45. Although one vacuum hole 45 is sufficient, two vacuum holes 45 are shown in the drawings to provide balance when the vacuum is activated. More than two vacuum holes may also be used to provide increased air flow to the interior chamber 40 in order to establish a stronger vacuum or provide better balance.

Figure 4:
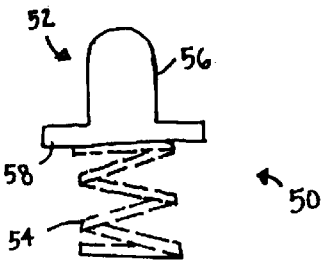
FIG. 4 is an elevational side view of a valve taught in accordance with the present invention.

FIG. 4 shows a valve 50 that is located within the interior chamber 40 to control the airflow between outside the vacuum control device 20 and the worktable 22. The valve 50 includes a plunger 52 and a spring 54. The plunger 52 has a stem 56 and a vacuum stop 58 that may be molded from a single piece of material or can be two separate pieces fastened together. The plunger 52 can be made from a durable polymer such as Delrin, a registered trademark of E.I. dupont de Nemours and Company, although other similar polymers and resins may be used.

Figure 5:
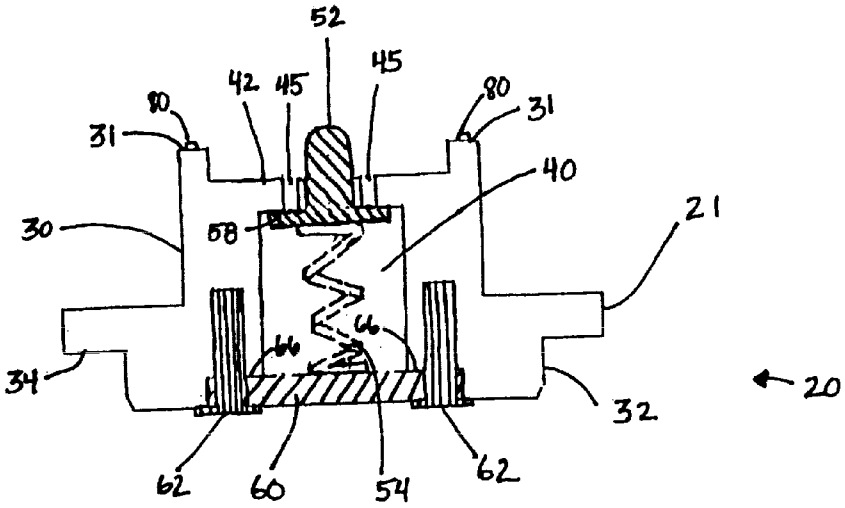
FIG. 5 is a cross-sectional side view of the vacuum control device as shown in FIG. 2 with the valve as shown in FIG. 4.

The plunger 52 is positioned in the interior chamber 40 as shown in FIG. 5 so that the stem 56 protrudes through the stem aperture 44 extending beyond the outmost plane of the vacuum control device 20. The plunger 52 is prevented from passing through the stem 56 aperture 44 by the vacuum stop 58 which has a surface area large enough to obstruct each vacuum hole 45, if present. The plunger 52 is forced against the top wall 42 by the spring 54 that is partially compressed between the vacuum stop 58 and a seating base 60.

In the preferred embodiment, the stem 56 has a continuous circumference substantially the same as the stem aperture 44. However, the stem may have a diameter substantially the same as the stem aperture near the vacuum stop and become continuously smaller as the stem extends away from the vacuum stop in other embodiments. This would allow for a vacuum control device 20 that did not utilize one or more vacuum holes 45 but instead relied upon the stem aperture 44 as the point of entry for outside air.

The seating base 60 covers the opening to the interior chamber 40 at the seating side 32 and is removably connected to the body 21 by one or more removable connectors 62. The removable connectors 62 may be plastic tree rivets, bolts, pins, or any other removable fasteners known by those skilled in the art. The seating base 60 should be porous so that air can flow from the interior chamber 40 to the recessed opening 24 when the vacuum control device 20 is used in combination with an operating vacuum pump 26. However, the seating base 60 needs to be rigid enough to withstand the force exerted from the spring 54 as it is compressed between the vacuum stop 58 and the seating base 60. The size of the pores should be of a size to prevent dirt, dust and other debris from passing into the worktable 22 to prevent fouling and maintain the longevity of the equipment.

Figure 6:
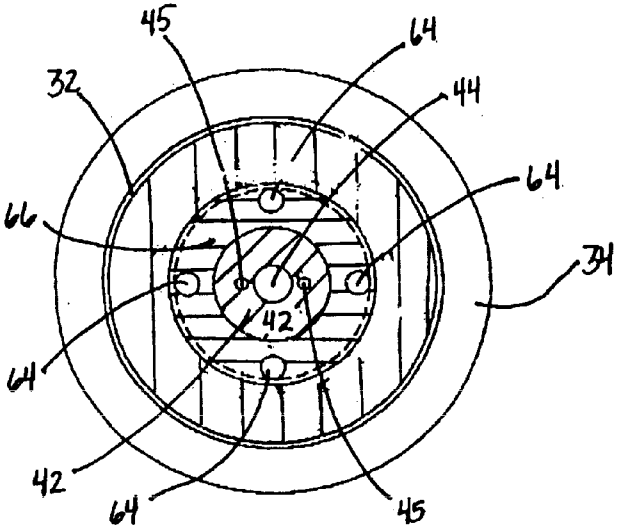
FIG. 6 is an elevational bottom view of the vacuum control device shown in FIG. 2 without a base and without the valve shown in FIG. 4.

FIG. 6 illustrates the seating side 32 before the seating base 60 is removably connected to the body 21. A base platform 66 coaxial with and intermediate the body 21 and the interior chamber 40 prevents the seating base 60 from entering the interior chamber 40. The base platform 66 has connector holes 64 that match each removable connector 62 used to removably fasten the seating base 60 to the body 21.

Referring again to FIG. 5, the spring 54 should be partially compressed to exert enough force on the vacuum stop 58 to hold the plunger 52 firmly against the top wall 42. The force necessary is dependent on the vacuum pressure drawn from the vacuum pump 26 that is connected to the worktable 22. The greater the vacuum pressure, the more force must be exerted on the vacuum stop 58 to keep the plunger 52 firmly against the top wall 42 and obstruct each vacuum hole 45. As such, it is necessary to use a spring 54 with sufficient tension to apply the force needed to hold the plunger 52 against the top wall 42 while the vacuum pump 26 is operating.

Figure 7:
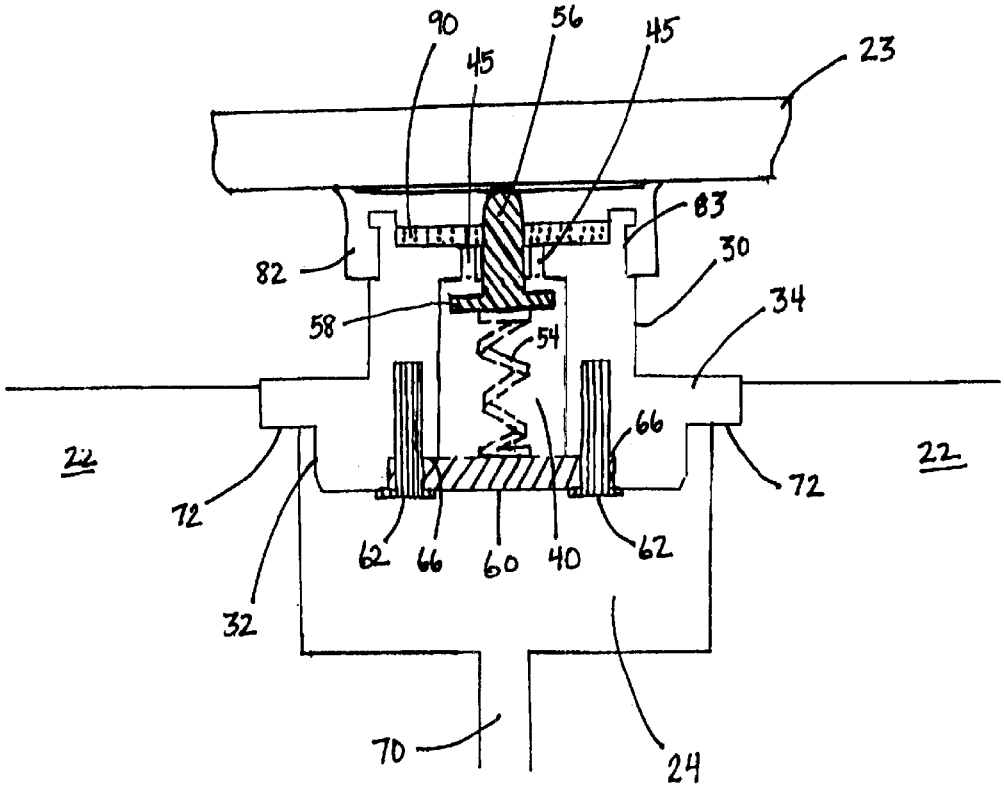
FIG. 7 is a cross-sectional side view of the vacuum control device as shown in FIG. 6 with an alternative seal ring as taught by the present invention placed in an operational position within a recessed opening of a worktable and supporting a workpiece.

FIG. 7 illustrates the vacuum control device 20 used in combination with a worktable 23. The vacuum control device 20 is positioned in the recessed opening 24 with the seating side 32 extending into the recessed opening 24 and the support side 30 rising above the worktable 22 away from the recessed opening 24. The flange 34 positions the vacuum control device 20 securely within the recessed opening 24 with the benefit of a ledge 72 that lies beneath the surface of the worktable 22 and surrounds the recessed opening 24. The flange 34 is sized and shaped to fit the ledge 72 in a mating relationship.

Air is drawn through an airflow valve 70 located at the floor 76 of the recessed opening 24 when a worker starts the vacuum pump 26 connected to the worktable 22 either before or after a workpiece 23 is set upon the vacuum control device 20. Air evacuates from the recessed opening 24 and from the interior chamber 40 through the base 60. However, the vacuum pump 26 cannot draw air from outside the vacuum control device 20 because the vacuum stop 58 obstructs each vacuum hole 45. This permits the air pressure within the recessed opening 24 and the interior chamber 40 to be at negative atmosphere pressure, creating the possibility of forming a vacuum.

The vacuum control device 20 is activated when a worker places a workpiece 23 onto the support side 30 as shown in FIG. 7. The weight of the workpiece 23 depresses the stem 56 of the plunger 52 and separates the vacuum stop 58 from the top wall 42 to clear each vacuum hole 45. When this occurs, air from between the workpiece 23 and the vacuum control device 20 will flow to the negative pressure through the interior chamber 40 and into the worktable 22 to form a vacuum that securely holds the workpiece 23 in place. If the vacuum control device 20 utilizes the stem aperture 44 to act as a vacuum hole when used in conjunction with a frustroconical stem (not shown in the drawings), the air will pass between the stem and the stem aperture 44 when the stem is depressed to allow formation of the vacuum.

A sealing ring 82 may be placed over the body 21 as shown in FIG. 7 to ensure a sufficient seal between the workpiece 23 and the vacuum control device 20. The sealing ring 82 is impervious to air which helps form a tight vacuum seal between the workpiece 23 and the vacuum control device 20. In addition, the sealing ring 82 is made from a material that is pliable and soft such as 50-durometer polyurethane. This type of material allows the sealing ring 82 to bend over any irregularities on the surface of the workpiece 23 to close gaps between the vacuum control device 20 and the workpiece 23. The sealing ring 82 also prevents damage to the workpiece 23 as the workpiece 23 is placed on the vacuum control device 20. In addition, the sealing ring 82 increases the friction coefficient between the workpiece 23 and the vacuum control device 20 to reduce the possibility of dangerous and costly slipping. Although 50-durometer polyurethane is described herein, any pliable material may be used that is impervious to air including without limitation rubber, resins, plastics, and polymers.

The sealing ring 82 may be constructed to fit over the support side 30 of the vacuum control device 20 while leaving open the middle portion of the sealing ring 82 so that the sealing ring 82 does not obstruct either the stem 56 or each vacuum hole 45. The sealing ring 82 may either be adapted to simply slip over the support side 30 or may engage the support side 30 at a ring notch 83. The ring notch 83 surrounds the support side 30 and prevents the sealing ring 82 from falling or lifting from the body 21. Other embodiments may include a single notch or ridges that extend outwardly to hold the sealing ring in place.

In an alternative embodiment of the present invention, an O-ring 80 or other type of gasket material may be placed on the resting surface 31 of the support side 30 as shown in FIG. 6. This will also help prevent air from passing between the workpiece 23 and the vacuum control device 20, prevent damage to the workpiece 23 and increase the friction coefficient between the workpiece 23 and the vacuum control device 20.

FIG. 7 also discloses a top filter 90 that is used to remove any dirt, dust or other debris from entering the interior chamber 40. The top filter 90 is situated on the top wall 42 opposite the interior chamber 40. The top filter 90 has an aperture that coincides with the stem aperture 44 of the top wall 42, allowing the stem 56 to freely protrude from the vacuum control device 20. The filter 90 is shaped to cover each vacuum hole 45 so that when the plunger 52 is depressed and the vacuum pump 26 is operating, air will pass through the filter 90 before entering the interior chamber 40. The top filter 90 may held in place by the sealing ring 82, which holds the top filter 90 firmly against the top wall 42. If a sealing ring 82 is not used in combination with the filter, clips, fasteners or other mechanisms known by those skilled in the art may be used.

The filter 90 used in the preferred embodiment has pores the size of approximately 120 microns, however, any pore size will work which prevents dirt, dust and other debris from entering the interior chamber 40 while allowing air flow. It is also an advantage to have a semi-permanent filter that may be cleaned by compressed fluids such as air or water. This same filter material may be used to construct the base 60, which will then act as a secondary filter 90 to remove any dirt, dust and other debris from entering into the worktable 22.

Figure 8:
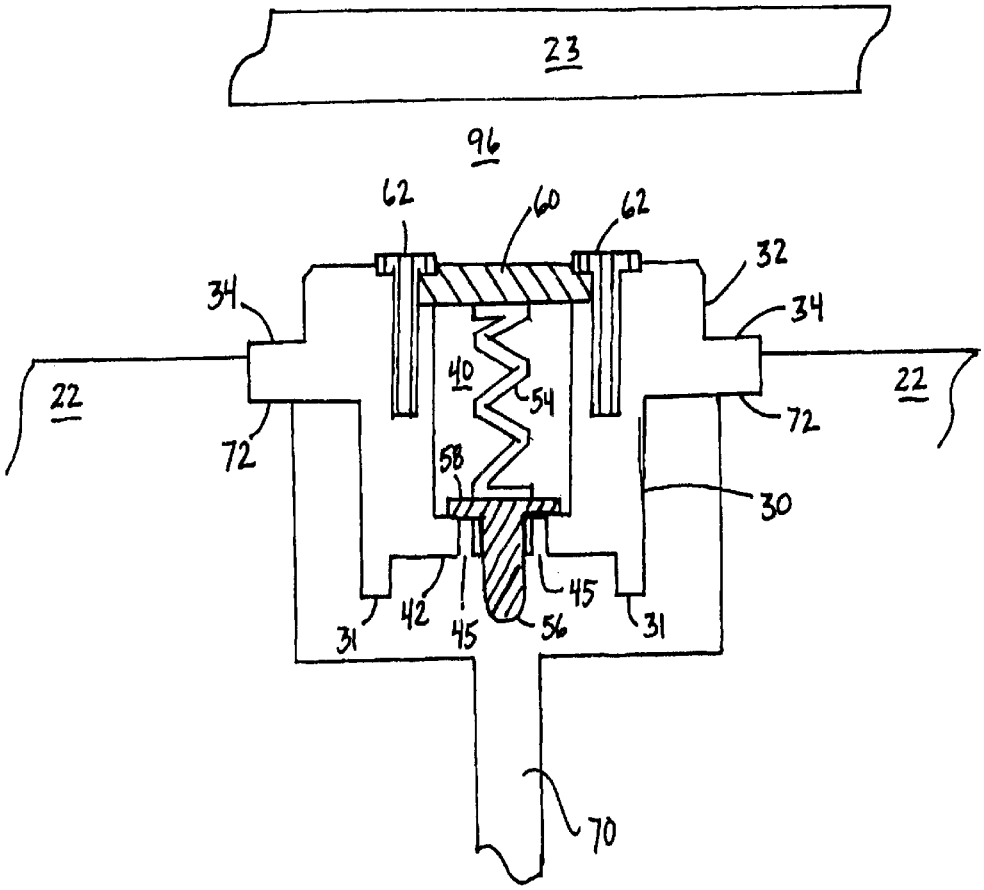
FIG. 8 is a vacuum control device in a cutting position and placed within the recessed opening of a worktable as taught in accordance with the present invention.

FIG. 8 shows the vacuum control device 20 of the present invention in a cutting position, which removes the vacuum control device 20 from the path of the machining tool 25 (shown in FIG. 1). In the cutting position, the support side 30 extends into the recessed opening 24 and the seating side 32 rises above the surface of the worktable 22 away from the recessed opening 24. With the support side 30 faced down into the recessed opening 24, the plunger 52 cannot be depressed to separate the vacuum stop 58 from the top wall 42 and clear each vacuum hole 45. As such, the vacuum control device 20 cannot be activated, and, as a result, air is prevented from entering the recessed opening 24.

The seating side 32 has a height less than the support side 30 as measured from the flange 34 to provide a space 96 between the vacuum control device 20 and a workpiece 23 setting upon the support side 30 of an adjacent vacuum control device 20 (adjacent vacuum control device not shown). This prevents the vacuum control device 20 from becoming damaged during the machining process and prevents damage to the machining tool 25. When multiple vacuum control devices are aligned in a cutting position, the vacuum control devices form a cutting path for the machining tool 25.

In all embodiments, the vacuum control device 20 is preferably made from a high impact polymer which will not damage the machine tool if accidentally hit and can be easily formed, molded or cut. However, the vacuum control device 20 may be made from any durable material that can be cut or machined.

Other advantages and features of this invention will become apparent from the claims made thereto, with the scope thereof determined by the reasonable equivalents, as would be understood by those skilled in the art.

We claim:

1. A vacuum control device to be used in combination with a worktable having at least one recessed opening and a vacuum source which draws air through said recessed opening, said vacuum control device comprising:

a body with a seating side, a support side and a flange separating said seating side from said support side, said body surrounding an interior chamber, a top wall partially closing said interior chamber on said support side, said top wall having a stem aperture and at least one vacuum hole, a base removably fastened to said body and covering said interior chamber at said seating side, a plunger located within said interior chamber, said plunger having a vacuum stop and a stem orthogonally projecting from said vacuum stop and of a size to protrude through said stem aperture, said vacuum stop of a size to obstruct each said vacuum hole when against said top wall, and a spring partially compressed between said vacuum stop and said base within said interior chamber.

2. The vacuum control device of claim 1 further comprising:

a seal ring partially covering said support side, and a filter closely adjacent said top wall and covering each said vacuum hole, said filter positioned between said top wall and a portion of said sealing ring.

3. The vacuum control device of claim 1 wherein a ring notch at least partially surrounds said support side.

4. The vacuum control device of claim 1 further comprising an O-ring placed atop said support side.

5. The vacuum control device of claim 1 wherein said top wall has two vacuum holes.

6. The vacuum control device of claim 1 wherein said vacuum stop is in the form of a disc.

7. The vacuum control device of claim 1 wherein said vacuum stop is polygonal.

8. The vacuum control device of claim wherein said body is constructed from a polymer.

* * * * *

UNITED STATES PATENT AND TRADEMARK OFFICE

CERTIFICATE OF CORRECTION

PATENT NO. : 6,439,559 B1 
DATED : August 27, 2002
INVENTOR(S) : Steve Patrick Kinnard, Eugene T. Plitt and Eugene W. Plitt It is certified that error appears in the above-identified patent and that said Letters Patent is hereby corrected as shown below:

Column 10,
Line 38, "claim" should be -- claim 1 --

Signed and Sealed this

Eleventh Day of November, 2003

JAMES E. ROGAN
*Director of the United States Patent and Trademark Office*